United States Patent [19]

Bartley

[11] 4,081,394

[45] Mar. 28, 1978

[54] SOAP BAR

[76] Inventor: Louise M. Bartley, 56-08 134th St., Flushing, N.Y. 11355

[21] Appl. No.: 724,304

[22] Filed: Sep. 17, 1976

[51] Int. Cl.[2] ..... C11D 9/00; C11D 17/00; C11D 17/04

[52] U.S. Cl. ..... 252/91; 40/2 C; 252/90; 252/134; 252/174; 252/DIG. 16

[58] Field of Search ..... 252/90, 91, 134, 174, 252/92, 93, DIG. 16; 40/2 C

[56] References Cited

U.S. PATENT DOCUMENTS

| | | | |
|---|---|---|---|
| 11,411 | 7/1895 | Wilson | 252/90 |
| 164,606 | 6/1875 | Strunz | 40/2 C |
| 366,535 | 2/1932 | Morgan | 252/90 |
| 540,825 | 6/1895 | Wilson | 252/90 |
| 692,481 | 2/1902 | Robinson | 252/90 |
| 710,939 | 10/1902 | Berry | 252/90 |
| 2,423,435 | 7/1947 | Block | 252/90 |
| 3,413,230 | 11/1968 | Dupuis | 252/92 |
| 3,969,256 | 7/1976 | Hadley | 252/92 |

*Primary Examiner*—Dennis L. Albrecht
*Attorney, Agent, or Firm*—Jacob L. Kollin

[57] ABSTRACT

A bar of soap comprising an outer shell of soft soap material, an intermediate shell of harder soap material and an inner core of still harder material. The inner core is inscribed with different words, some of which entitle the user to a free prize after the inner core has been reached by the user.

2 Claims, 4 Drawing Figures

SOAP BAR

SUMMARY OF THE INVENTION

The invention relates to soap manufacture and particularly to the manufacture of soap bars.

An object of the invention is to provide a bar of soap containing improved means for holding the soap material together in order that the soap material may be entirely used up without breaking into small pieces.

Still another object of the invention is to provide a bar of soap having an outer soft soap layer, an intermediate harder soap layer and a hard inner core.

Another object of the invention is to provide an inner core imprinted with different words whereby, when some of these words are found on the inner core by the user, particularly a child, they will entitle the user to a prize, thereby providing an incentive to fully use up the soap.

In the drawing

Figure 1:
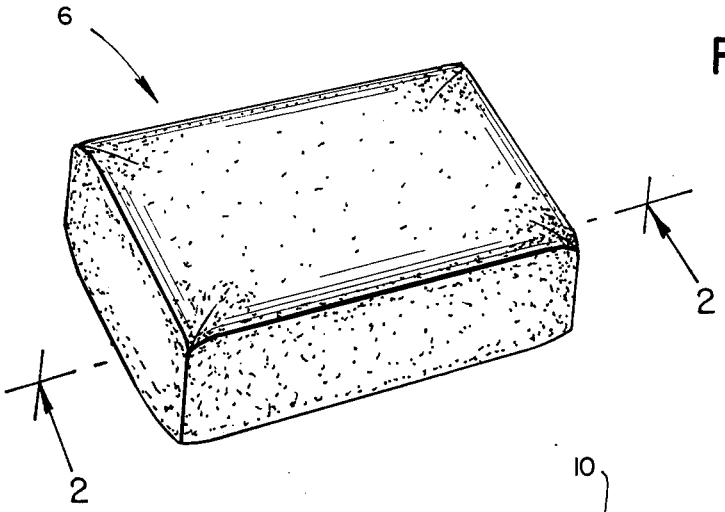
FIG. 1 is a perspective view of a cake of soap, according to the invention.
Figure 2:
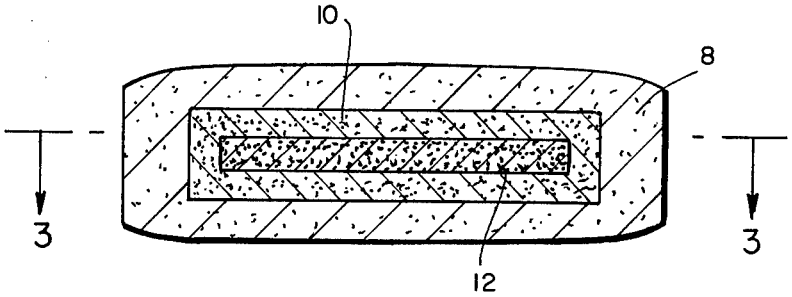
FIG. 2 is a cross-section taken on line 2—2 of FIG. 1.
Figure 3:
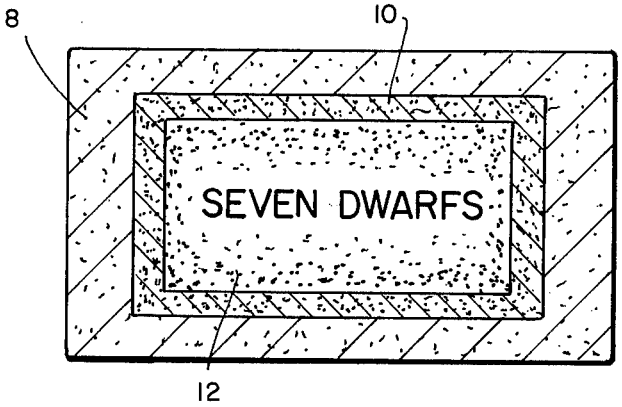
FIG. 3 is a section taken on line 3—3 of FIG. 2, showing one legend in the cake of soap, shown in FIG. 1.
Figure 4:
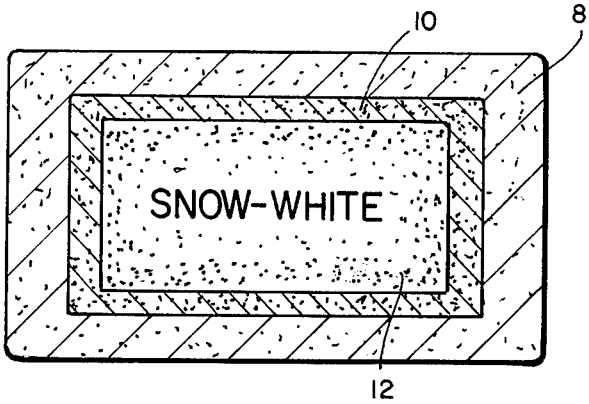
FIG. 4 is a section taken on line 3—3 of FIG. 2 of another legend version in the cake of soap shown in FIG. 1.

Referring now to the drawing in detail, the cake of soap comprises an outer soap shell 8, an intermediate soap shell 10 and an inner core 12.

The outer shell 8, is made of a soap of consistency, usually employed in the manufacture of soap. The intermediate shell 10, is made of a soap of a firmer and harder consistency then the outer shell. The inner core 12 is made of a soap of harder and firmer consistency than that of the intermediate shell.

As explained in the following paragraph the soap manufacturer may offer a limited number of prizes to the few soap users who find the legend "SEVEN DWARFS" on cores 12. It will be appreciated that, as in other prize contests, not all contestants are winners.

One of the faces of core 12 of a relatively large number of soap cakes 6, is imprinted with the legend "SEVEN DWARFS", while one of the faces of a substantially smaller amount of cores 12 is imprinted with the legend "SNOW WHITE".

The object of imprinting the inner core with the two different legends is to provide an incentive to users, particularly to children, to use the soap, so that they may win a prize when they reach the core inscribed with the legend "SEVEN DWARFS", offered by the soap manufacturer.

The provision of an intermediate harder layer prevents the breaking of the soap cake into small pieces after the outer layer has been used up, as is the case in conventional cakes of soap. Similarly, the harder inner core remains intact until it, too, is fully used up. This prevents a substantial waste of soap.

Having thus described by invention, what I claim and desire to secure by Letters Patent of the United States of America is:

1. As an article of manufacture, a cake of soap comprising an outer soft shell of soap, an intermediate soap shell harder than the outer shell, said intermediate soap shell being completely enclosed in said outer shell, an inner core of soap harder than the intermediate soap shell, said inner core of soap being completely enclosed in said intermediate soap shell.

2. An article of manufacture as claimed in claim 1, wherein said inner core is inscribed with one kind of legend.

* * * * *